US006796101B2

(12) United States Patent
Chen

(10) Patent No.: US 6,796,101 B2
(45) Date of Patent: Sep. 28, 2004

(54) METAL TUBES FOR GUARDRAIL

(76) Inventor: Yuan-Kuan Chen, 4FL., 27 Lane 160, Hsin Sheng S. Rd. Sec. 1, Taipei 100 (TW)

( * ) Notice: Subject to any disclaimer, the term of this patent is extended or adjusted under 35 U.S.C. 154(b) by 0 days.

(21) Appl. No.: 10/261,691

(22) Filed: Oct. 2, 2002

(65) Prior Publication Data

US 2004/0065045 A1 Apr. 8, 2004

(51) Int. Cl.[7] ..... E04C 2/54

(52) U.S. Cl. ..... 52/781; 52/780; 52/696; 256/24; 256/59; 403/278; 403/326

(58) Field of Search ..... 52/729.12, 729.5, 52/781, 780, 729.1, 800.12; 403/278, 282, 373, 374.1, 338, 326; 256/59, 165.01, 68, 70, 24, 19

(56) References Cited

U.S. PATENT DOCUMENTS 431,193 A * 7/1890 Pennycook ..... 52/308
3,334,462 A * 8/1967 Brooks ..... 52/460
3,517,474 A * 6/1970 Lanternier ..... 52/729.5
3,854,269 A * 12/1974 Hancock ..... 220/683
3,962,827 A * 6/1976 Chaffee ..... 49/384
3,991,981 A * 11/1976 Wu ..... 256/65
4,586,697 A * 5/1986 Tomya ..... 256/65
4,676,469 A * 6/1987 Rotermund et al. ..... 248/243
4,690,383 A * 9/1987 Batcheller ..... 256/24
5,200,240 A * 4/1993 Baker ..... 256/65
5,396,735 A * 3/1995 Dietrich ..... 49/499.1
6,293,523 B1 * 9/2001 Fendler ..... 256/27
6,460,310 B1 * 10/2002 Ford et al. ..... 52/729.1
6,546,675 B1 * 4/2003 Adderton ..... 52/71
2003/0085394 A1 * 5/2003 Ochoa

* cited by examiner

*Primary Examiner*—Carl D. Friedman
*Assistant Examiner*—Nahid Amiri
(74) *Attorney, Agent, or Firm*—Troxell Law Office PLLC

(57) ABSTRACT

A guardrail comprises two parallel metal tubes each having two lengthwise bent ends each having a fastening member, two inner abutment mechanisms each having a lengthwise abutment member and a mating fastening member at either end engaged with the fastening member for securing each metal tube and the corresponding abutment mechanism together, and a protective board having either end urged against the abutment member and the bent ends, thereby securing the protective board between the abutment mechanisms. Further, a number of variations are possible.

7 Claims, 6 Drawing Sheets

METAL TUBES FOR GUARDRAIL

BACKGROUND OF THE INVENTION

1. Field of the Invention

The present invention relates to guardrail structure and more particularly to a metal tube structure for guardrail with improved characteristics.

2. Description of Related Art

A conventional guardrail comprises two parallel metal tubes with a protective board mounted in between. Such metal tube 100 is shown in FIGS. 14 and 15 and is formed by bending an elongate strip of steel sheet material 90 into a hoop, pressing from underside to form an elongate groove 92 having a section of inverted U and a top abutment plate 91, and welding the hoop along a weld line 93 to finish the product.

However, the prior art suffered from several disadvantages. For example, an additional polishing step is required to smooth the weld line 93. Further, the metal tube 100 may be not straight after the welding. Furthermore, the manufacturing process is time consuming, not economical. Also, both welding and polishing are risky jobs and may contaminate the environment.

Thus, it is desirable to provide an improved metal tube structure for guardrail in order to overcome the above drawbacks of the prior art.

SUMMARY OF THE INVENTION

It is an object of the present invention to provide a metal tube structure for guardrail so as to effect a mass production through a simple process.

It is another object of the present invention to provide a metal tube structure for guardrail in which no welding and polishing is required for maintaining a straightness of the metal tube during the manufacturing process. As such, advantages such as a saving of time, a reduction of cost, and a safe working environment without contamination are obtained.

It is still another object of the present invention to provide a metal tube structure for guardrail in which the metal tube can be made smaller since the metal tube is assembled with the variety depths of inner abutment mechanism. This in turn can reduce a consumption of material.

It is a further object of the present invention to provide a metal tube structure for guardrail in which no additional polishing is required since there is no weld line on the abutment member. As a result, a quality of the finished product is increased.

It is still further object of the present invention to provide a metal tube structure for guardrail in which different depths of troughs of inner abutment mechanisms are made possible for being adapted to a single metal tube. This effect a great flexibility in configuring the guardrail.

To achieve the above and other objects, the present invention provides a metal tube for guardrail comprises a C section-shaped metal tube having two lengthwise bent ends each having a fastening member, and an inner abutment mechanism each having a lengthwise abutment member and a mating fastening member at either end thereof engaged with the fastening member of the metal tube when the inner abutment mechanism is inserted into the metal tube for securing each metal tube and the corresponding inner abutment mechanism together to form a complete assemblying metal tube for guardrail.

Preferably, to achieve the above and other objects, the present invention provides a guardrail comprising a pair of parallel metal tubes each having a section of C, a lengthwise gap, and two first bent ends along the gap, each first bent end having a lengthwise inner section and a lengthwise first groove; a pair of inner abutment mechanisms each having a section of U, a horizontal abutment member, a trough defined by two vertical sections and the abutment member, and a pair of second bent ends along the trough, each second bent end having two lengthwise outer sections and two lengthwise second grooves wherein the second bent end is put on the inner section with the outer section inserted into the first groove and the inner section inserted into the second groove for securing each metal tube and the corresponding abutment mechanism together; and a protective board having either end urged against the abutment member and the first bent ends, thereby securing the protective board between the abutment mechanisms.

In one aspect of the present invention, either vertical section is bent to cause the vertical section and the first bent end to be at the same flat surface urged against the protective board.

Preferably, to achieve the above and other objects, the present invention further provides a guardrail comprising a pair of parallel metal tubes each having a section of C, a lengthwise gap, and two vertical ends along the gap, each vertical end having a lengthwise horizontal inner section; a pair of inner abutment mechanisms each including a horizontal abutment member having two lengthwise bent ends and two lengthwise grooves in the bent ends; wherein the bent end is put on the inner section with the inner section inserted into the groove for securing each metal tube and the corresponding abutment mechanism together; and a protective board having either end urged against the abutment member and the vertical ends, thereby securing the protective board between the abutment mechanisms.

In another aspect of the present invention, either abutment member is bent to have a section of U so that the protective board is urged by the vertical ends and either abutment member.

Preferably, to achieve the above and other objects, the present invention further provides a metal tube structure for guardrail comprising:

an outer metal tube having a section of C, a lengthwise gap formed between two flat ends, a horizontal inner section formed perpendicular to each of the flat end; and an inner abutment mechanism having a horizontal abutment member which has two bent ends each with a groove formed therein;

wherein each of the horizontal inner section of the outer metal tube is inserted into each of corresponding groove of the inner abutment mechanism together to form a complete metal tube for guardrail.

The above and other objects, features and advantages of the present invention will become apparent from the following detailed description taken with the accompanying drawings.

DETAILED DESCRIPTION OF THE PREFERRED EMBODIMENTS

Figure 1:
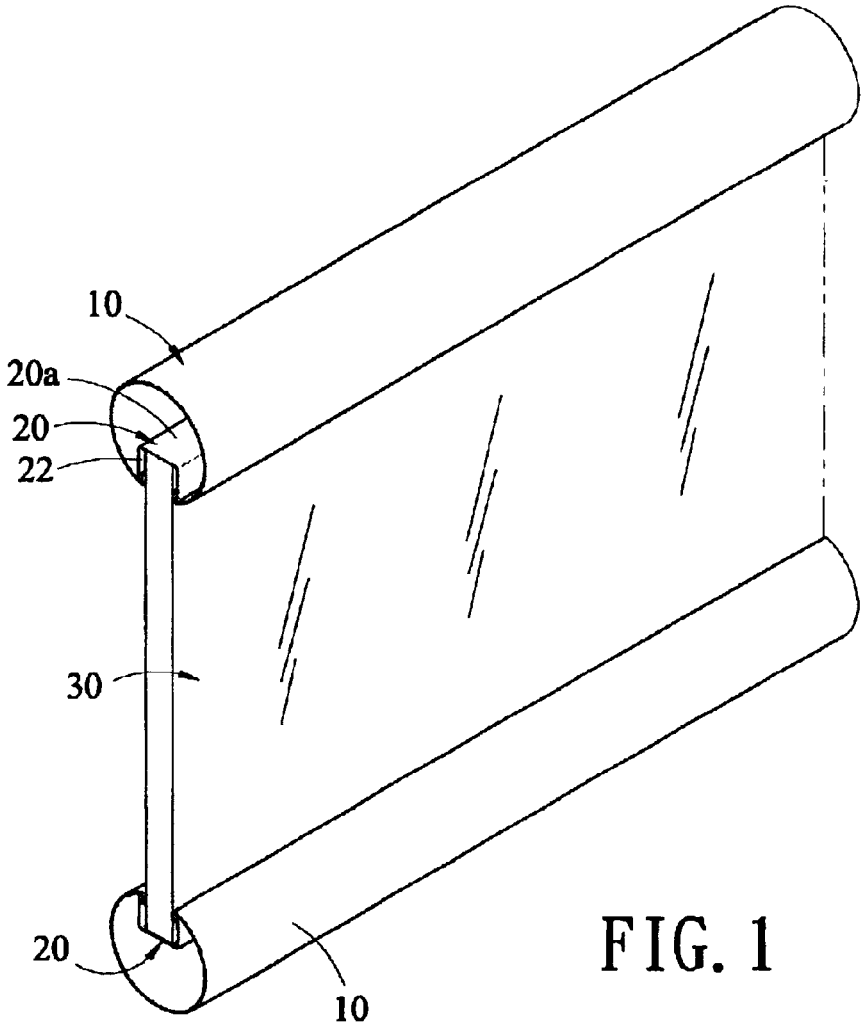
FIG. 1 is a perspective view of a first preferred embodiment of a pair of parallel metal tubes with a mounted protective board in between forming a guardrail according to the invention.
Figure 2:
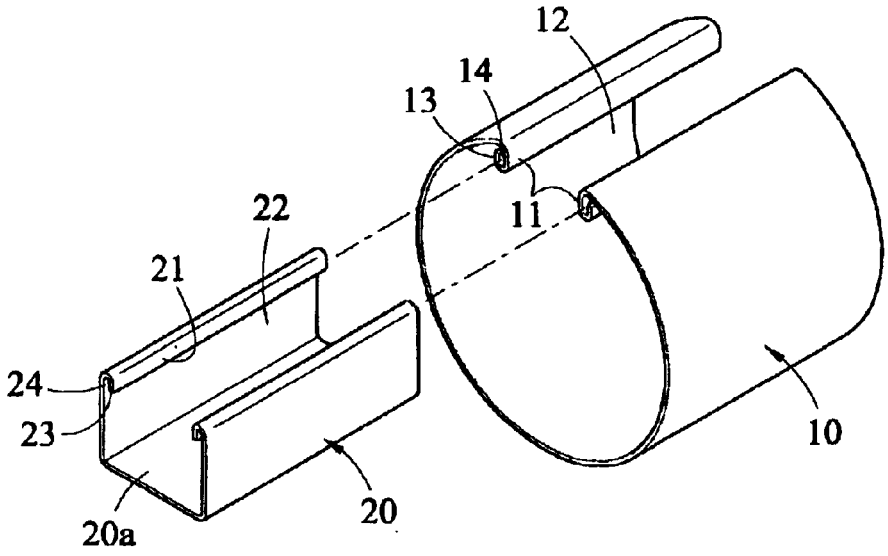
FIG. 2 is an exploded perspective view of metal tube and inner abutment mechanism of FIG. 1.
Figure 3:
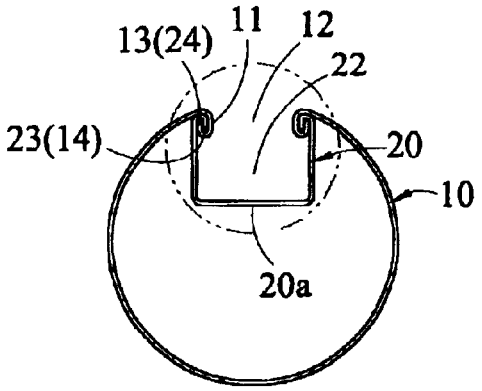
FIG. 3 is a cross-sectional view of the assembled metal tube and inner abutment mechanism of FIG. 1.
Figure 4:
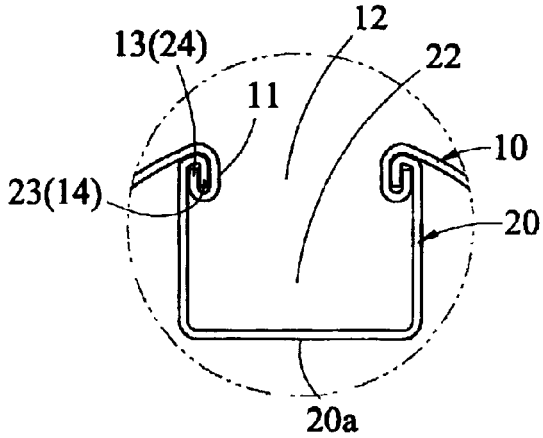
FIG. 4 is a greatly enlarged fragmentary view of a circle shown in FIG. 3.

The metal tube for guardrail of the present invention mainly comprises an outer C-section metal tube having a lengthwise gap and two lengthwise bent ends, each having a fastening member, and an inner abutment mechanism having a lengthwise abutment member and a mating fastening member at either end engaged with the fastening member of the metal tube when the inner abutment mechanism is inserted into the metal tube for securing each metal tube and the corresponding inner abutment mechanism together to form a complete assemblying metal tube for guardrail.

In order to understand the best mode of the present invention, please refer to FIGS. 1 to 4, there is shown a guardrail constructed in accordance with a first preferred embodiment of the invention. The guardrail comprises a pair of parallel metal tubes 10, a pair of inner abutment mechanisms 20 each provided in the metal tube 10, and a protective board 30 mounted between the inner abutment mechanisms 20. Each of above components will now be described in detail below.

The metal tube 10 is formed by bending an elongate strip of metal sheet material into one having a section of C, a lengthwise gap 12, and two bent ends 11 along the gap 12. In each bent end 11, there are further formed a lengthwise inner section 13 and a lengthwise groove 14 (the best mode of the fastening member) by bending. The inner abutment mechanism 20 is also formed by bending an elongate strip of metal sheet material to have a section of U. The inner abutment mechanism 20 comprises a horizontal abutment member 20*a*, a trough 22, a pair of bent ends 21, two outer sections 23 at the bent ends 21, and two grooves 24 (the best mode of the mating fastening member) at the bent ends 21 all disposed lengthwise. The protective board 30 is selected from glass board, wood, metal board, non-metal board, or the like.

Following is a description of an assembly of one pair of the metal tube 10 and the inner abutment mechanism 20. First ride the bent ends 21 of the inner abutment mechanism 20 on the inner sections 13 of the metal tube 10 with the outer sections 23 of the inner abutment mechanism 20 inserted into the grooves 14 of the metal tube 10 and the inner sections 13 of the metal tube 10 inserted into the grooves 24. A description of an assembly of another pair of the metal tube 10 and the inner abutment mechanism 20 will not be described in detail below since it is a mirror image of the above assembly. Preferably, a fastening of the metal tube 10 and the inner abutment mechanism 20 by slightly deforming the bent ends 11, 21 at either side of the metal tube 10 is performed by means of a tool. This can prevent the metal tube 10 and the inner abutment mechanism 20 from disengaging lengthwise. But in fact a stop member is provided at either side of either metal tube 10 of guardrail. Hence, above fastening of the metal tube 10 and the inner abutment mechanism 20 is not critical. Next, mount either end of the protective board 30 on the abutment member 20*a* of the inner abutment mechanism 20. Either end of the protective board 30 is urged by both bent ends 11 of the metal tube 10 and the abutment member 20*a* of the inner abutment mechanism 20. Hence, the protective board 30 is secured between the bent ends 21 of inner abutment mechanisms 20. Note that the inner abutment mechanism 20 is enclosed by the metal tube 10. In other words, an aesthetic factor may not be considered. Thus, it is possible of using an inexpensive material or the like to replace the metal material used herein without degrading a structural strength of the finished guardrail. This can reduce a manufacturing cost as one advantage of the invention.

Figure 5:
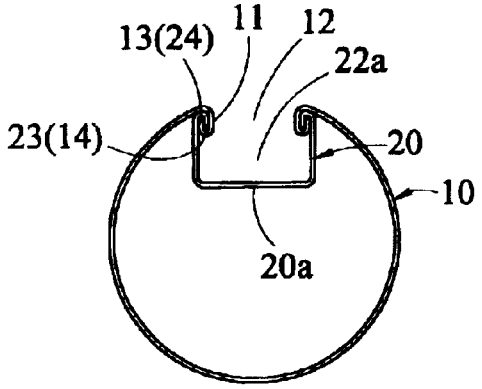
FIG. 5 is a cross-sectional view of assembled metal tube and inner abutment mechanism according to a second preferred embodiment of the invention.
Figure 6:
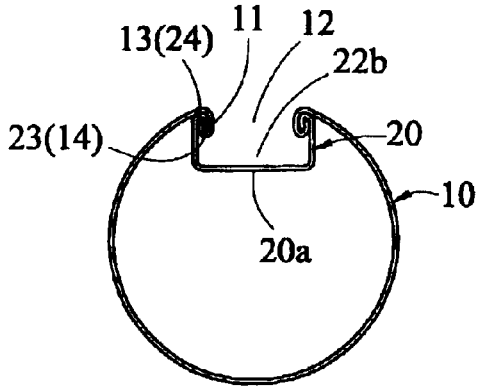
FIG. 6 is a cross-sectional view of assembled metal tube and inner abutment mechanism according to a third preferred embodiment of the invention.

Referring to FIGS. 5 and 6, second and third preferred embodiments of the invention are illustrated. The only difference therebetween is different depths of troughs 22*a* and 22*b*. That is, the depth of the trough 22*a* is larger than that of the trough 22*b*. These preferred embodiments enable the metal tube 10 to be adapted to various inner abutment mechanisms 20 having different trough depths as another advantage of the invention.

Figure 7:
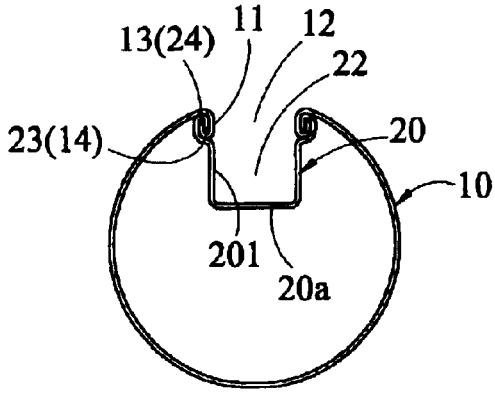
FIG. 7 is a cross-sectional view of assembled metal tube and inner abutment mechanism according to a fourth preferred embodiment of the invention.
Figure 8:
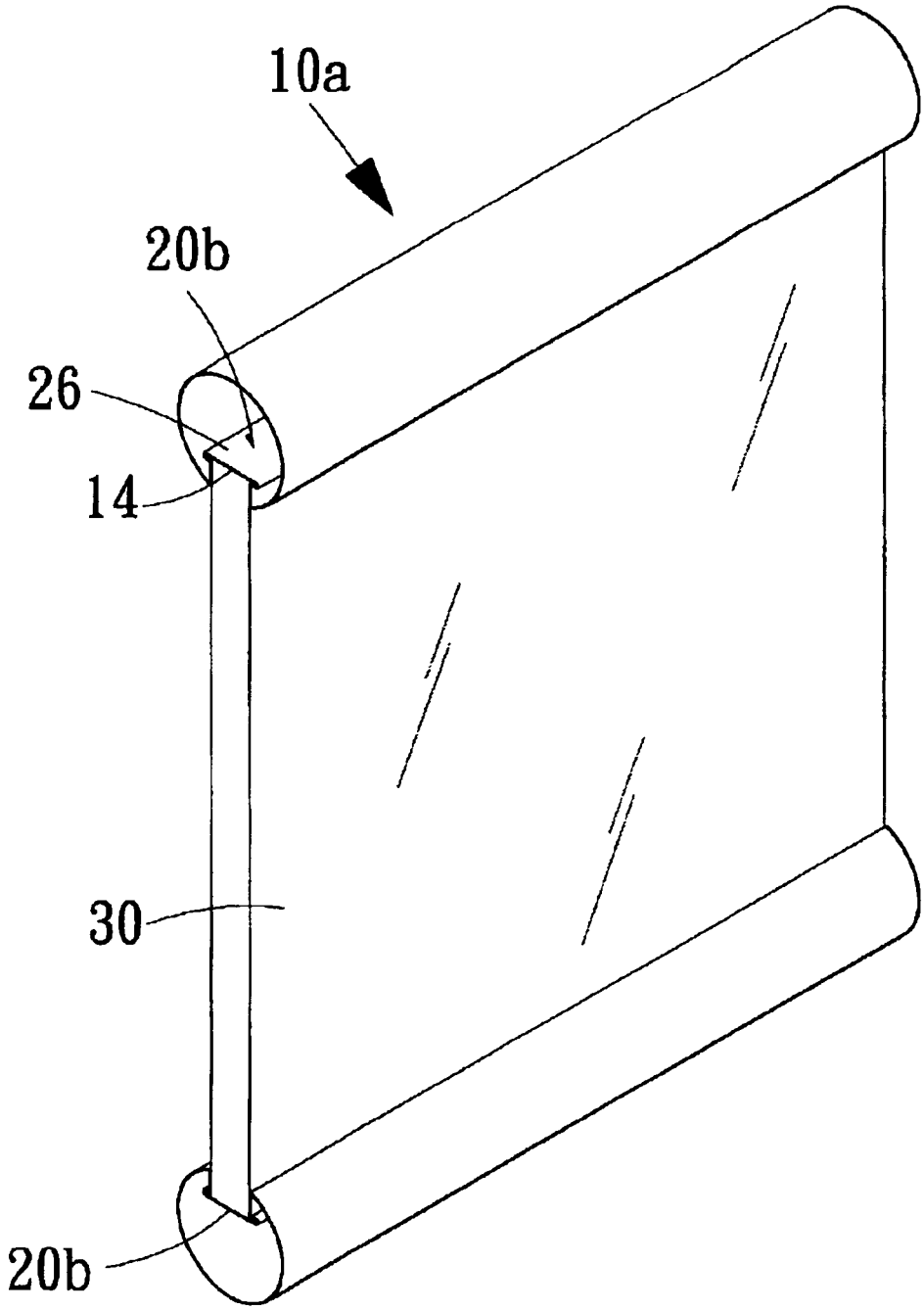
FIG. 8 is a perspective view of a pair of parallel metal tubes with a mounted protective board in between forming a guardrail according to a fifth preferred embodiment of the invention.
Figure 9:
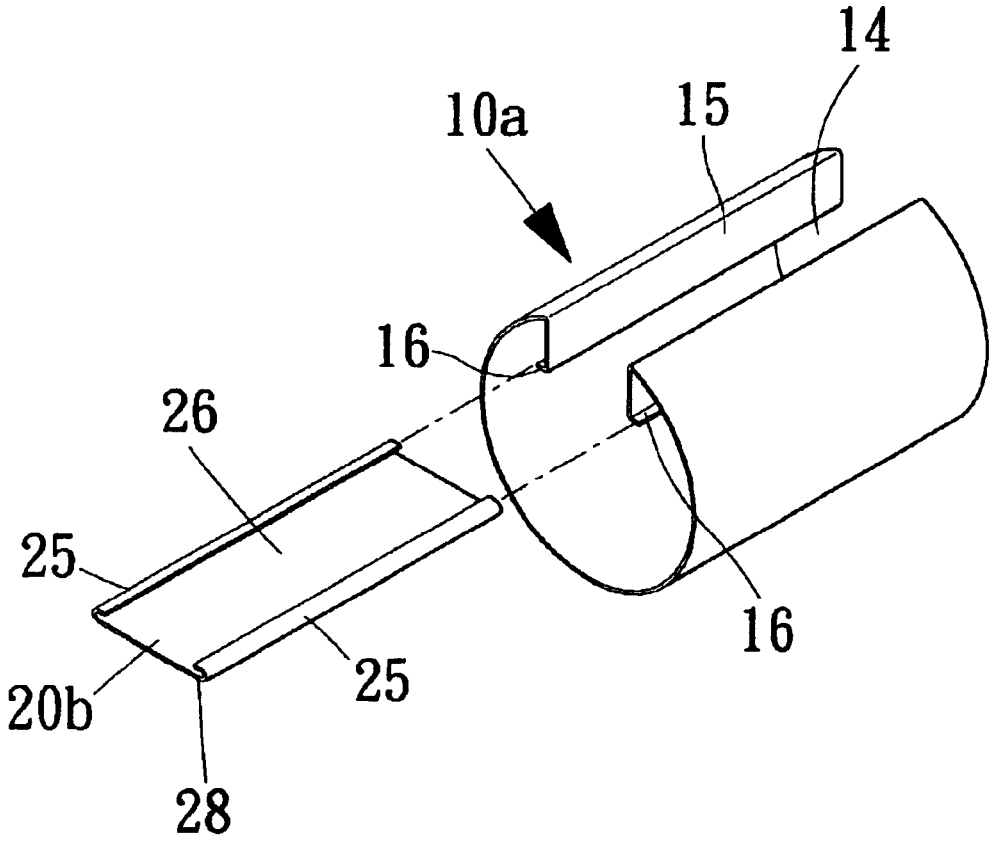
FIG. 9 is an exploded perspective view of metal tube and inner abutment mechanism of FIG. 8.
Figure 10:
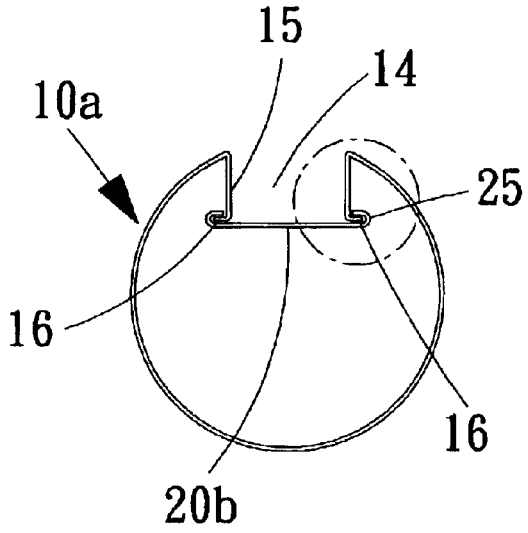
FIG. 10 is a cross-sectional view of the assembled metal tube and inner abutment mechanism of FIG. 8.
Figure 11:
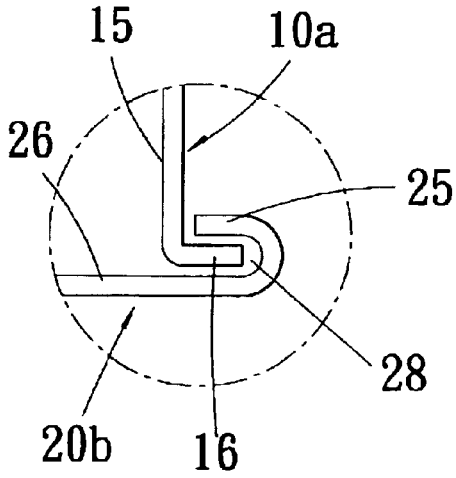
FIG. 11 is a greatly enlarged fragmentary view of a circle shown in FIG. 10.

Referring to FIG. 7, a fourth preferred embodiment of the invention is illustrated. The characteristic of the fourth preferred embodiment is detailed below. A portion of either vertical section 201 adjacent the bent end 21 of the inner abutment mechanism 20*a* is further bent inward to cause the vertical section 201 and the bent end 11 of the metal tube 10 to be at the same flat surface. This can increase a contact area between the protective board 30 and both the inner abutment mechanism 20 and the metal tube 10, thereby enhancing a fastening of the protective board 30.

Referring to FIGS. 8, 9, 10, and 11, a fifth preferred embodiment of the invention is illustrated. The characteristics of the fifth preferred embodiment are detailed below. In each flat end 15 of the metal tube 10*a*, there are further formed a horizontal inner section 16 (fastening member) perpendicular to the flat end 15. The inner abutment mechanism 20*b* comprises a horizontal abutment member 26 having two bent ends 25 with grooves 28 (mating fastening member) formed therein.

Following is a description of an assembly of one pair of the metal tube 10*a* and the inner abutment mechanism 20*b*.

First slide the bent ends 25 of the inner abutment mechanism 20*b* on the inner sections 16 of the metal tube 10*a* with the inner sections 16 inserted into the grooves 28 of the inner abutment mechanism 20*b*. Preferably, a fastening of the metal tube 10*a* and the inner abutment mechanism 20*b* by slightly deforming the ends 15, 25 at either side of the metal tube 10*a* is performed by means of a tool. This can prevent the metal tube 10*a* and the inner abutment mechanism 20*b* from disengaging lengthwise. The assembly is easiest among all above preferred embodiments. Further, a contact area between the protective board 30 and both the inner abutment mechanism 20*b* and the metal tube 10*a* is much increased (i.e., either end of the protective board 30 is urged by both flat ends 15 of the metal tube 10*a* and the abutment member 26 of the inner abutment mechanism 20), thereby enhancing a fastening of the protective board 30 as another advantage of the invention.

Note that a bending of either metal tube 10*a* or inner abutment mechanism 20*b* is done by means of rollers or the like. This can eliminate the welding and polishing steps employed by the prior art, resulting in a reduction of the manufacturing cost.

Figure 12:
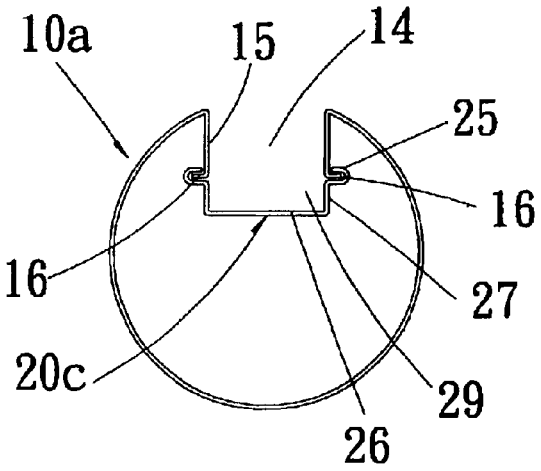
FIG. 12 is a cross-sectional view of assembled metal tube and inner abutment mechanism according to a sixth preferred embodiment of the invention.
Figure 13:
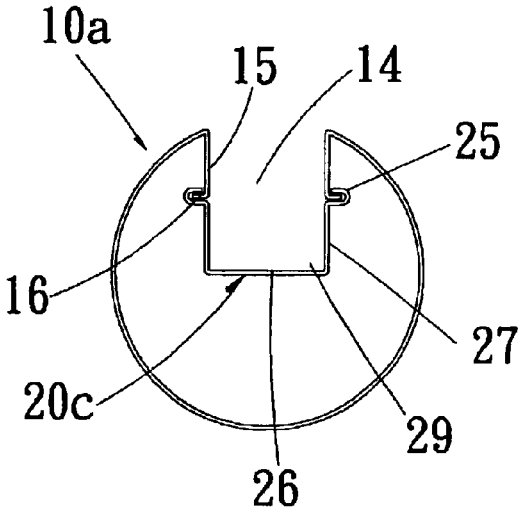
FIG. 13 is a cross-sectional view of assembled metal tube and inner abutment mechanism according to a seventh preferred embodiment of the invention.
Figure 14:
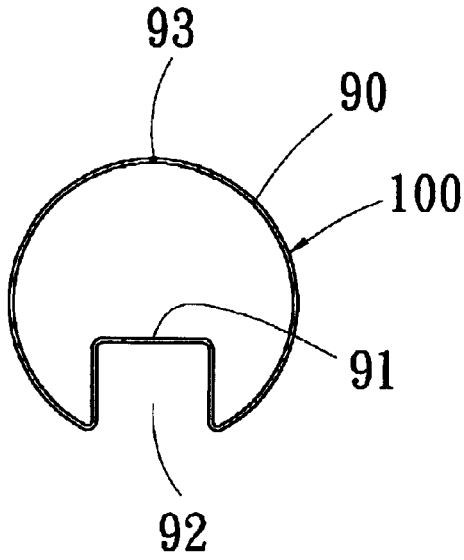
FIG. 14 (PRIOR ART)
FIG. 14 is a cross-sectional view of a conventional metal tube for guardrail.
Figure 15:
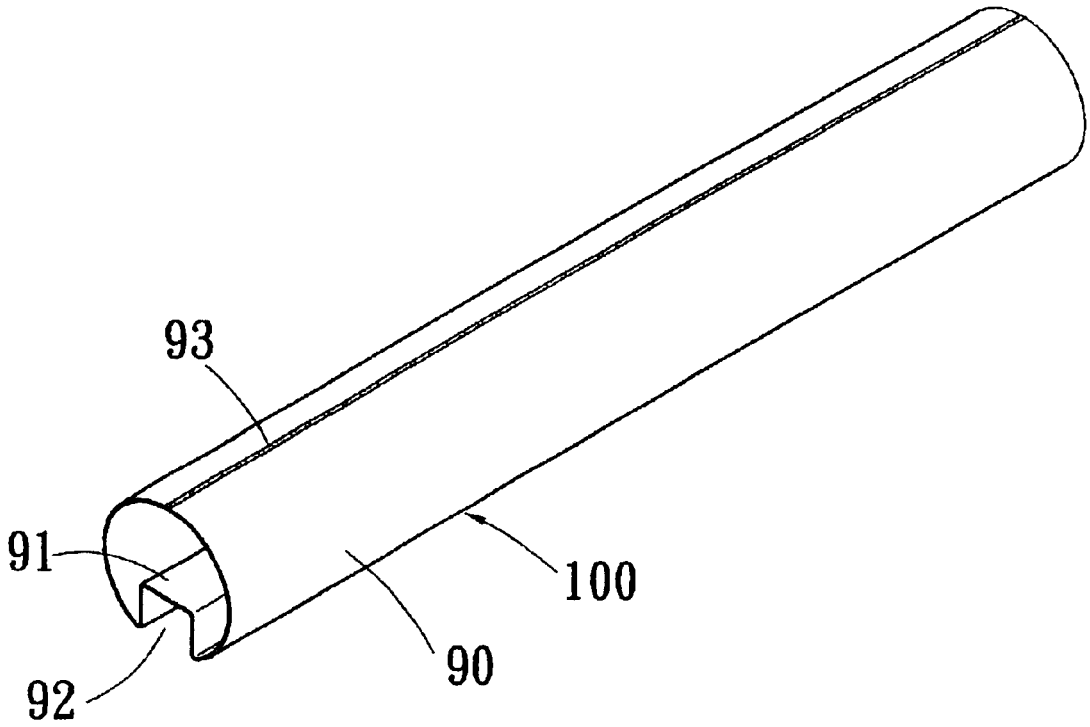
FIG. 15 (PRIOR ART)
FIG. 15 is a perspective view of the metal tube shown in FIG. 14.

Referring to FIGS. 12 and 13, sixth and seventh preferred embodiments of the invention are illustrated. These two preferred embodiments are basically variations of the fifth preferred embodiment. For example, as shown in FIG. 12, the characteristics of the sixth preferred embodiment are that the inner abutment mechanism 20*c* is shaped to have a section of U. The inner abutment mechanism 20*c* has two bent ends 25 each extended from the vertical section 27 and a horizontal abutment member 26. Inner sections 16 of the metal tube 10*a* are clamped firmly by the bent ends 25. Referring to FIG. 13, it is found that the only difference between the sixth and seventh preferred embodiments is different depths of troughs 29. That is, the depth of the trough 29 of the seventh preferred embodiment is larger than that of the trough 29 of the sixth preferred embodiment. These preferred embodiments enable the metal tube 10*a* to be adapted to various inner abutment mechanisms 20*c* having different trough depths as another advantage of the invention.

Note that the invention can be applied to any other devices (e.g., slides, posts, guiding slot, rail etc.) other than the above guardrail. Also, a section of the metal tube may be half-circle, square, or the like other than the above circle. Moreover, the inner abutment mechanism may not be recessed in any other embodiments.

The benefits of this invention include:

I. Neither welding nor polishing is required during the process of assembling metal tube and inner abutment mechanisms. Thus, it is possible of effecting a mass production through a simple process.

II. No welding and polishing means a saving of time, a reduction of cost, and a safe working environment without contamination.

III. The metal tube can be made smaller since the metal tube is assembled with the variety depths of inner abutment mechanism. This in turn can reduce a consumption of material. Moreover, the inner abutment mechanism is enclosed by the metal tube. Hence, an aesthetic factor may not be considered. Thus, it is possible of using an inexpensive material to replace the metal material used herein without degrading a structural strength of the finished guardrail. This can further reduce a manufacturing cost.

IV. No additional polishing is required since there is no weld line on the abutment member. As a result, a quality of the finished product is increased.

V. Different depths of troughs of inner abutment mechanisms are made possible for being adapted to a single metal tube. Such flexible arrangements are desired by those skilled in the art.

While the invention herein disclosed has been described by means of specific embodiments, numerous modifications and variations could be made thereto by those skilled in the art without departing from the scope and spirit of the invention set forth in the claims.

What is claimed is:

1. A guardrail comprising:

a pair of parallel metal tubes each having a section of C, a lengthwise gap, and two vertical ends along the gap, each vertical end having a lengthwise horizontal inner section;

a pair of inner abutment mechanisms each including a horizontal abutment member having two lengthwise bent ends and two lengthwise grooves in the bent ends wherein the bent end is put on the inner section with the inner section inserted into the groove for securing each metal tube and the corresponding abutment mechanism together; and a protective board having either end urged against the abutment member and the vertical ends, thereby securing the protective board between the abutment mechanisms.

2. A guardrail comprising:

a) two metal tubes with a C-shaped cross section, each of the two metal tubes having:
   i) a first pair of bent ends;
   ii) a lengthwise gap formed between the first pair of bent ends; and
   iii) two fastening members, one fastening member formed on each of the first pair of bent ends;

b) two inner abutment mechanisms, each of the two inner abutment mechanisms having:
   i) a horizontal abutment member; and
   ii) two mating fastening members, wherein each of the two fastening members slidably engages one of the two mating fastening members; and c) a protective board having two opposing ends, each of the two opposing ends being inserted into the lengthwise gap of one of the two metal tubes.

3. The guardrail according to claim 2, further comprising two second vertical sections located on each of the two metal tubes, each second vertical section being located between one of the two first pair of bent ends and an outer circumference of one of the two metal tubes.

4. The guardrail according to claim 3, wherein each of the two fastening members on each of the two metal tubes includes fiat section; and each of the two mating fastening members includes a second groove, wherein each flat section is slidably inserted into one second groove.

5. A tube assembly for a guardrail comprising:

a) a metal tube with a C-shaped cross section and having:
   i) a first pair of bent ends;
   ii) a lengthwise gap formed between the first pair of bent ends; and
   iii) two fastening members, one fastening member formed on each of the first pair of bent ends; and b) an inner abutment mechanism having:
   i) a horizontal abutment member; and
   ii) two mating fastening members, wherein each of the two fastening members slidably engages one of the two mating fastening members.

6. A metal tube structure for guardrail comprising:

an outer metal tube having a section of C having two vertical flat ends, one vertical flat end extending from each of two ends of the C section, a lengthwise gap formed between the two vertical flat ends, a horizontal inner section formed at a lower end of each of the two vertical flat ends and extending toward an outside of the lengthwise gap and perpendicular to each of the two vertical flat ends; and an inner abutment mechanism having a horizontal abutment member which has two bent ends each extending from an outer end thereof toward an inner side of the horizontal abutment member and having a horizontal groove extending toward the inner side of the horizontal abutment member formed therein;

wherein each of the horizontal inner section of the outer metal tube is inserted into each of corresponding horizontal groove of the inner abutment mechanism together to form a complete assemblying metal tube for guardrail.

7. The guardrail of claim 6, wherein the inner abutment mechanism is further shaped to have a section of U, and the inner abutment mechanism has two bent ends, each extended from an upper end of a vertical section and a horizontal abutment member of the section U, and each of the inner sections of the metal tube is inserted into each of the corresponding bent end of the inner abutment mechanism together to form a complete assemblying metal tube for guardrail.

* * * * *